US010500435B2

(12) United States Patent
Balsells Mercade et al.

(10) Patent No.: US 10,500,435 B2
(45) Date of Patent: Dec. 10, 2019

(54) PEDAL

(71) Applicant: Manufacturas Y Transformados AB, S.L., Igualada (Barcelona) (ES)

(72) Inventors: Antoni Balsells Mercade, Igualada (ES); Santiago Lucas Serra, Igualada (ES)

(73) Assignee: MANUFACTURAS Y TRANSFORMADOS AB, S.L., Igualada (Barcelona) (ES)

( * ) Notice: Subject to any disclaimer, the term of this patent is extended or adjusted under 35 U.S.C. 154(b) by 60 days.

(21) Appl. No.: 15/102,153

(22) PCT Filed: Dec. 5, 2014

(86) PCT No.: PCT/ES2014/070900
§ 371 (c)(1),
(2) Date: Jun. 6, 2016

(87) PCT Pub. No.: WO2015/082750
PCT Pub. Date: Jun. 11, 2015

(65) Prior Publication Data

US 2016/0325133 A1 Nov. 10, 2016

(30) Foreign Application Priority Data

Dec. 5, 2013 (ES) ..... 201331783

(51) Int. Cl.
*A63B 21/00* (2006.01)
*A63B 22/06* (2006.01)
*A63B 22/00* (2006.01)

(52) U.S. Cl.
CPC ..... *A63B 21/4034* (2015.10); *A63B 22/0046* (2013.01); *A63B 22/0605* (2013.01); *A63B 2225/60* (2013.01)

(58) Field of Classification Search
CPC ..... A63B 21/40; A63B 22/00; A63B 22/06; A63B 2225/06
See application file for complete search history.

(56) References Cited

U.S. PATENT DOCUMENTS 581,095 A * 4/1897 Willard ..... B62M 3/08 74/594.4
4,172,217 A * 10/1979 Miller ..... H01H 21/26 200/343
4,726,438 A * 2/1988 Stuertz ..... B60N 3/06 180/90.6

(Continued)

FOREIGN PATENT DOCUMENTS

DE 202004003631 U1 6/2004
DE 202007001105 U1 5/2007

(Continued)

*Primary Examiner* — Garrett K Atkinson
(74) *Attorney, Agent, or Firm* — Hayes Soloway PC

(57) ABSTRACT

The pedal comprises a base (1) on which to place a user's foot and a transverse hole (8) for a rotation shaft, characterised in that it comprises at least one element (4) which is less dense than water arranged above said transverse hole (8) for a rotation shaft.
It makes it possible for the base on which the foot is placed to always remain in an optimal position when the device is placed in water and before the user places his or her foot thereon, allowing comfortable placement of the foot.

9 Claims, 2 Drawing Sheets

(56) References Cited

U.S. PATENT DOCUMENTS 5,116,295 A * 5/1992 Dunn ..... A63B 21/0084 482/111
5,219,317 A * 6/1993 Beasley ..... A63B 21/0084 441/61
5,411,454 A * 5/1995 Chang ..... A61H 7/00 482/148
5,441,466 A * 8/1995 Piaget ..... A63B 21/0085 297/423.46
5,480,365 A * 1/1996 Lundin ..... A63B 22/0056 482/53
5,588,939 A * 12/1996 Zheng ..... A63B 22/0605 482/57
5,624,356 A * 4/1997 Roberts ..... A63B 22/0046 482/57
5,928,113 A * 7/1999 Roberts ..... A63B 22/0046 482/57
6,003,408 A * 12/1999 Hervig ..... B62M 3/08 482/57
6,241,639 B1 * 6/2001 Hervig ..... A63B 22/0046 482/57
6,572,514 B1 * 6/2003 Calafato ..... A63B 22/0056 482/79
7,485,792 B2 * 2/2009 Collins, Sr. ..... G10H 1/32 84/422.1
7,614,978 B2 * 11/2009 Piaget ..... A63B 21/0085 482/112
7,803,089 B2 * 9/2010 Roimicher ..... B62M 3/08 482/51
7,955,225 B1 * 6/2011 James ..... A63B 22/0664 482/51
D773,567 S * 12/2016 Chuang ..... D21/668
2003/0017916 A1 * 1/2003 Juan ..... A63B 22/0056 482/51
2003/0092538 A1 * 5/2003 Kuo ..... A63B 22/0056 482/79
2004/0048721 A1 * 3/2004 Chou ..... A63B 22/0056 482/52
2005/0025646 A1 * 2/2005 Miller ..... A61M 3/0262 417/472
2007/0202996 A1 * 8/2007 Lu ..... A63B 22/0056 482/52
2007/0295190 A1 * 12/2007 Collins ..... G10H 1/32 84/422.1

FOREIGN PATENT DOCUMENTS

GB 2292321 A 2/1996
WO 9841289 A1 9/1998
WO 2004067106 A1 8/2004
WO 2010074368 A1 7/2010

* cited by examiner

PEDAL

The present invention relates to a pedal, particularly to a pedal for physical exercise devices used in water.

BACKGROUND OF THE INVENTION

The use of physical exercise devices such as, for example, stationary bicycles, in gymnasiums is common. One type of such devices is used in water for doing a physical exercise called "hydrospinning" in English.

This type of exercise consists of pedalling in water and has the advantage over other conventional physical exercise devices that water offers greater and more constant resistance due to the friction of water, with the ensuing beneficial effects.

In order to perform this type of sporting activity, special bicycles have been designed for this use, which include pedals adapted to be in contact with water.

Specifically, these pedals comprise a base on which the bicycle user's foot is placed and a foot strap for holding the foot in place during the pedalling action. Additionally, said base includes a vertical pushing element on its lower front portion to make it easier to push against the water while pedalling.

A drawback of currently known pedals for this type of bicycles is that they are not balanced due to the presence of said vertical pushing element and do not remain in an optimal predefined position when inside the water and are not used, but rather inclined in an uncomfortable position for the user on introducing his or her foot in the pedal.

Therefore, a first objective of the present invention is to provide a pedal for physical exercise devices that is adequate for use with aquatic physical exercise devices, such that they remain in an optimal, substantially horizontal position, when not in use, so that the user can insert his or her foot comfortably when he or she wishes to use the device.

DESCRIPTION OF THE INVENTION

The pedal of the invention solves the aforementioned drawbacks and also has other advantages that will be described below.

The pedal in accordance with the present invention comprises a base on which to place a user's foot and a transverse hole for a rotation shaft, characterised in that it comprises at least one element, which is less dense than water arranged above said transverse hole for a rotation shaft.

Preferably, said at least one element, which is less dense than water, is arranged inside said base.

Advantageously, said at least one element, which is less dense than water, is/are arranged in one or more complementary housings.

According to a preferred embodiment, said base is formed by two bodies, which can be coupled to each other, defining one or more housings therebetween.

Preferably, said at least one element, which is less dense than water, is removably assembled in its housing so as to place and remove them appropriately when required.

Said base comprises a transverse hole for a rotation shaft and said elements, which are less dense than water, are preferably arranged on both sides of said transverse hole in order to properly balance the pedal.

According to alternative embodiments, said element(s), which are less dense than water, has/have a circular or polygonal design.

According to a preferred embodiment, said element(s), which is/are less dense than water, is/are made of expanded polystyrene or air deposits, independent or formed sealing the cavities in said base, and said bodies that form the base are made of injected plastic.

If desired, said base may comprise a pushing element assembled removably on its lower portion.

Advantageously, the surface of the base of said pedal on which the foot rests, incorporates a plurality of projections for holding the foot and obtaining physiological improvements during the use thereof.

With the pedal in accordance with the present invention, the base on which the foot is placed always remains in the optimal position when the device is placed in water and before the user places his or her foot thereon, allowing comfortable placement of the foot.

BRIEF DESCRIPTION OF THE DRAWINGS

In order to make the foregoing more readily understandable, a set of drawings is attached wherein, schematically and only by way of illustration and not limitation, a practical embodiment is represented.

DESCRIPTION OF A PREFERRED EMBODIMENT

Figure 1:
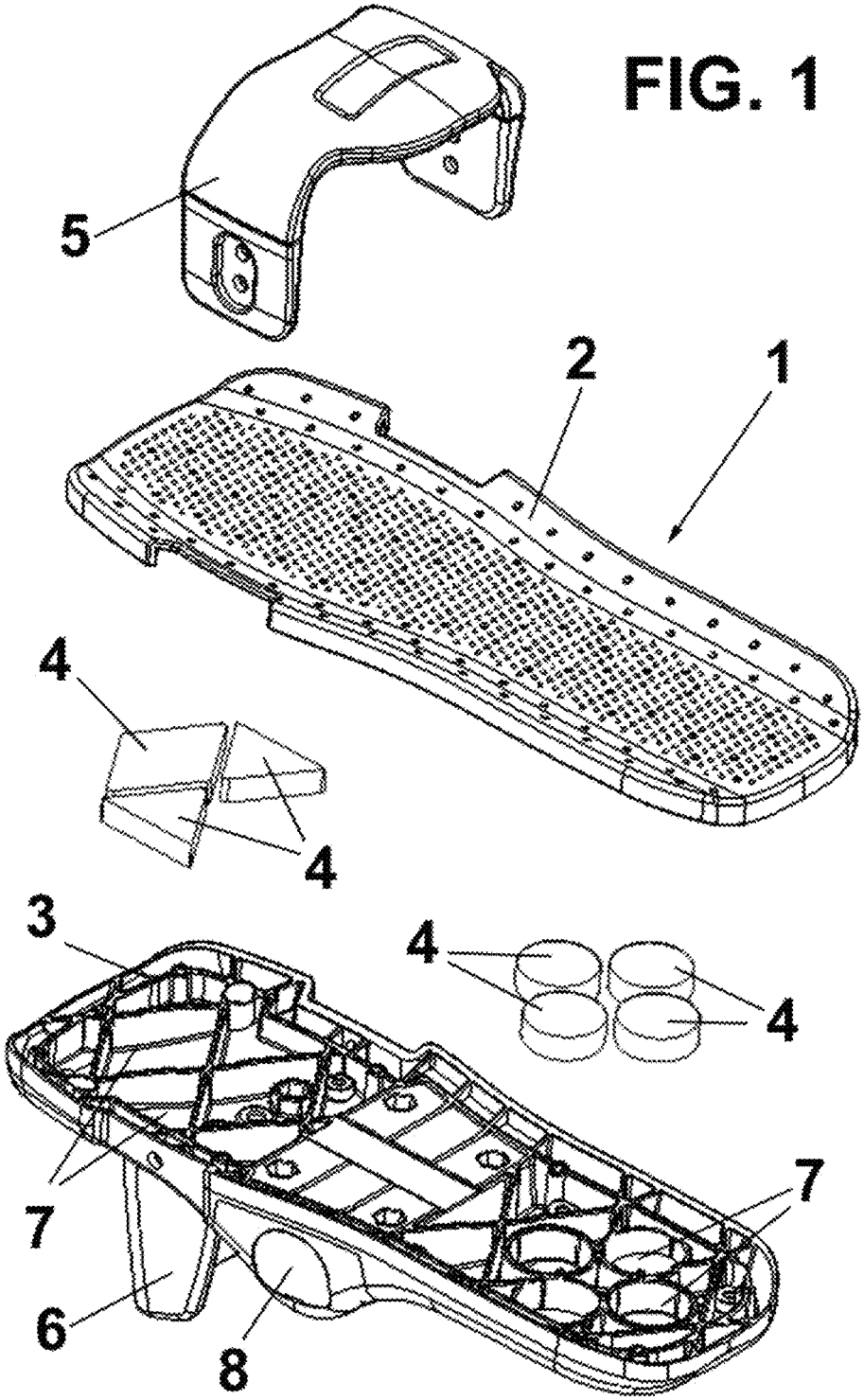
FIG. 1 shows an exploded perspective view of the components of the pedal in accordance with the present invention.

In FIG. 1, the constituent components of the pedal in accordance with the present invention can be observed.

Specifically, the pedal comprises a base, generally indicated by numerical reference 1, on which the user's foot is placed which, in accordance with the embodiment represented, is formed by two bodies that can be coupled to each other, an upper body 2 and a lower body 3.

Additionally, the pedal in accordance with the present invention also comprises one or various elements 4, which are less dense than water that will also be indicated in the present description as "low-density elements" for the sake of simplicity.

The pedal also comprises a foot strap 5 for holding a user's foot in its use position and a pushing element 6 vertically arranged on the lower portion of said lower body 3.

Said base 1 also comprises a transverse hole 8 for arranging a shaft (not represented) that will join the pedal to the bicycle.

Said low-density elements 4 are advantageously arranged on top of said transverse hole 8, for example, arranged removably in housings 7 defined in said base 1, specifically on the lower body 3, in accordance with the embodiment represented. In this manner, the low-density elements 4 can be suitably distributed in said housings 7 in order to properly balance the pedal.

Said low-density elements 4 may be made of any appropriate material which is less dense than water, for example, expanded polystyrene or air-filled cavities, and may have a design of any appropriate shape, such as circular or polygonal (triangular, square, rectangular, etc.).

Figure 2:
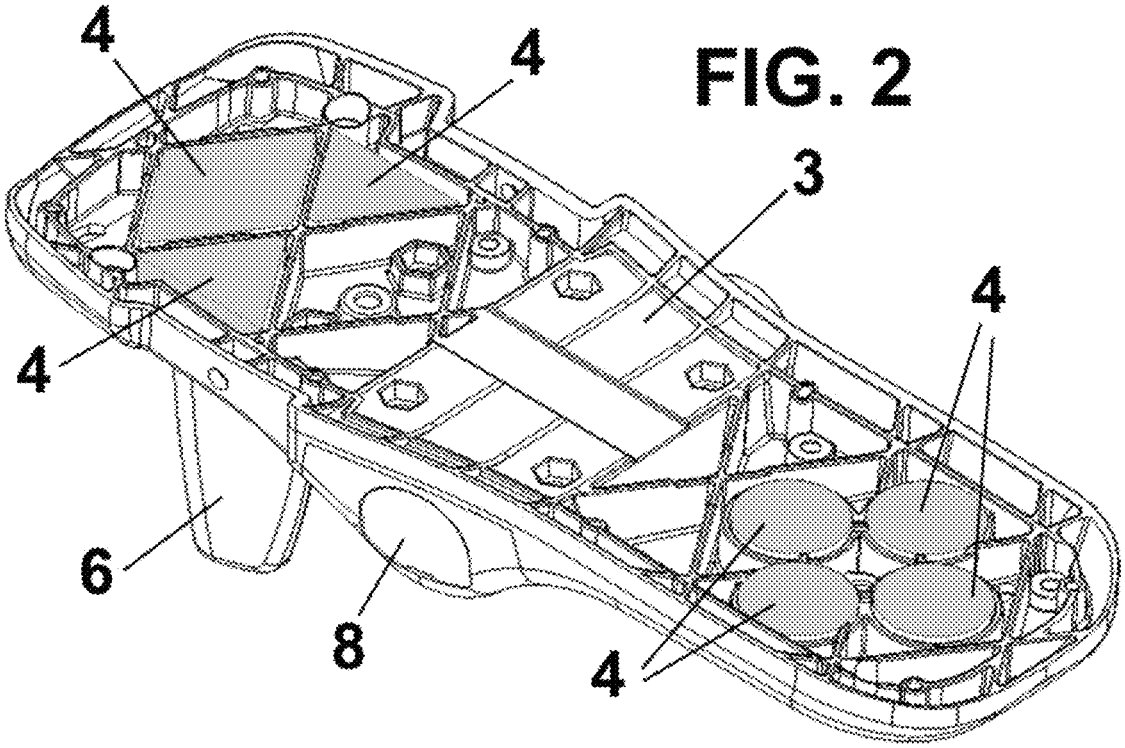
FIG. 2 shows a perspective view of the lower body of the pedal in accordance with the present invention, with the low-density elements in their use position in their respective housings.
Figure 3:
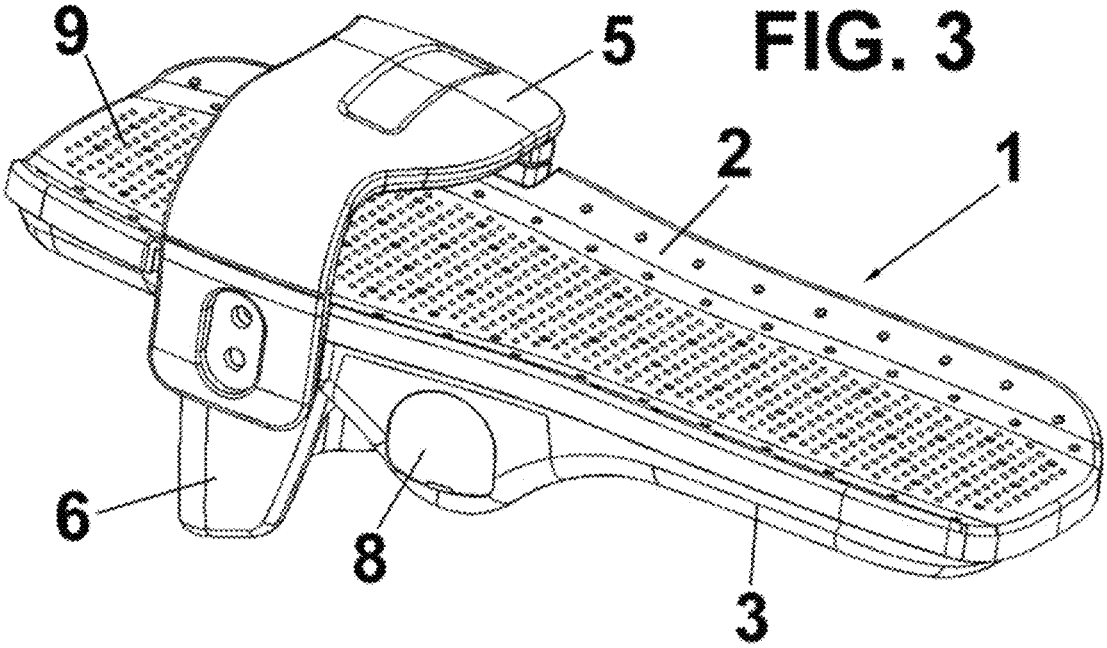
FIG. 3 shows a perspective view of the pedal in accordance with the present invention.

In order to achieve the proper balance, said low-density elements 4 are advantageously arranged on both sides of said transverse hole 8, as can be better observed in FIG. 2. The arrangement of said low-density elements 4 will be such that the upper portion of the pedal will remain in an optimal position to facilitate the placement of a user's foot on the base 1.

As indicated above, said base 1 is formed by two bodies 2, 3, which can be coupled to each other, such that they may be separated to place or remove said low-density elements 4 in the housings 7.

Said bodies 2, 3 are preferably made of injected plastic and, in accordance with the embodiment represented, completely cover said low-density elements 4, such that the users cannot see their presence or arrangement. However, it should be noted that said low-density elements 4 may be arranged in any appropriate position, not necessarily in the interior of the base 1.

If desired, said pushing element 6 may be removably assembled on said lower body 3 in order to replace said pushing element 6 with another having other characteristics, for example shorter or longer, when desired.

Additionally, the surface of the base 1 of said pedal on which the foot rests, incorporates a plurality of projections 9 for fixing the foot and obtaining physiological improvements during the use thereof.

Despite having made reference to a specific embodiment of the invention, it is evident for the person skilled in the art that the described pedal is susceptible of many variations and modifications, and that all the aforementioned details may be replace with other, technically equivalent ones, without detracting from the scope of protection defined by the attached claims.

The invention claimed is:

1. A hydrospinning pedal comprising:

a base comprising a top base portion on which a user's foot is placed and a bottom base portion removably coupled to the top base portion;

a transverse hole through the bottom base portion to movably mount the base on a rotation shaft, wherein the transverse hole is positioned between a front of the base and a rear of the base; and one or more elements, which are less dense than water arranged between the top base portion and the bottom base portion above the transverse hole and wherein said one or more elements are arranged on both sides of said transverse hole; wherein said base comprises a pushing element removable assembled on the bottom base portion, and wherein the pushing element is configured to facilitate movement of the pedal through water during hydrospinning.

2. The pedal, according to claim 1, wherein said one or more elements, which are less dense than water, are arranged inside said base.

3. The pedal, according to claim 2, further comprising one or more complementary housings formed on the bottom base portion wherein said one or more elements, which are less dense than water, are arranged in said one or more complementary housings.

4. The pedal, according to claim 3, wherein said one or more complementary housings have an opening covered by the top base portion.

5. The pedal, according to claim 4, wherein said top base portion and said bottom base portion are made of injected plastic.

6. The pedal, according to claim 1, wherein said one or more elements, which are less dense than water, are removably assembled in housings, whereby the one or more elements are removable by decoupling the top base portion and the bottom base portion.

7. The pedal, according to claim 1, wherein said one or more elements, which are less dense than water, have a circular or polygonal design.

8. The pedal, according to claim 1, wherein said one or more elements, which are less dense than water, are made of expanded polystyrene or air deposits.

9. The pedal, according to claim 1, wherein said base comprises a plurality of projections on the top base portion.

* * * * *